US006997152B2

(12) United States Patent
Harris

(10) Patent No.: US 6,997,152 B2
(45) Date of Patent: Feb. 14, 2006

(54) LOCK-PIN CARTRIDGE FOR A VALVE DEACTIVATION ROCKER ARM ASSEMBLY

(75) Inventor: Wayne S. Harris, Hilton, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/721,033

(22) Filed: Nov. 24, 2003

(65) Prior Publication Data

US 2004/0103869 A1 Jun. 3, 2004

Related U.S. Application Data

(63) Continuation-in-part of application No. 10/134,263, filed on Apr. 29, 2002, now Pat. No. 6,668,775.

(51) Int. Cl.
*F01L 1/18* (2006.01)

(52) U.S. Cl. ..... 123/90.39; 123/90.16; 123/90.44

(58) Field of Classification Search ..... 123/90.16, 123/90.39, 90.41, 90.44, 90.45, 90.4, 90.42, 123/90.43, 90.46; 74/519, 559
See application file for complete search history.

(56) References Cited

U.S. PATENT DOCUMENTS 5,515,820 A * 5/1996 Sugimoto et al. ..... 123/90.16
6,325,030 B1 * 12/2001 Spath et al. ..... 123/90.16
6,394,052 B1 * 5/2002 Miyasaka et al. ..... 123/90.17

* cited by examiner

*Primary Examiner*—Thomas Denion
*Assistant Examiner*—Ching Chang
(74) *Attorney, Agent, or Firm*—Patrick M. Griffin

(57) ABSTRACT

A lock-pin cartridge for a valve deactivation rocker arm assembly. The cartridge comprises a body having an axial bore having first and second ends, the second end having a closure and a passage therethrough. A piston assembly comprising a locking pin and a piston is disposed in the bore. The locking pin extends through the second end passage to provide latching and unlatching of rocker arm elements. The piston is spaced apart from the ends to define a hydraulic chamber and a spring chamber within the bore on opposite sides of the piston. A spring is disposed in the spring chamber for urging the piston assembly toward one of the first and second ends. The hydraulic chamber includes means for communicating with a supply of hydraulic fluid for actuating the piston assembly.

12 Claims, 7 Drawing Sheets

LOCK-PIN CARTRIDGE FOR A VALVE DEACTIVATION ROCKER ARM ASSEMBLY

This application is a Continuation-In-Part of a pending U.S. patent application Ser. No. 10/134,263, filed Apr. 29, 2002 now U.S. Pat. No. 6,668,775.

TECHNICAL FIELD

The present invention relates to mechanisms for altering the actuation of valves in internal combustion engines; more particularly, to a valve actuating mechanism such as a finger follower type rocker arm having means for changing between high and low or no valve lifts; and most particularly, to a pre-assembled lock-pin cartridge for a two-step finger follower type rocker arm.

BACKGROUND OF THE INVENTION

Variable valve activation (VVA) mechanisms for internal combustion engines are well known. It is known to be desirable to lower the lift, or even to provide no lift at all, of one or more valves of a multiple-cylinder engine, especially intake valves, during periods of light engine load. Such deactivation can substantially improve fuel efficiency.

Various approaches have been disclosed for changing the lift of valves in a running engine. One known approach is to provide an intermediary cam follower arrangement which is rotatable about the engine camshaft and is capable of changing both the valve lift and timing, the cam shaft typically having both high-lift and low-lift lobes for each such valve. Such an arrangement can be complicated and costly to manufacture and difficult to install onto a camshaft during engine assembly.

Another known approach is to provide a deactivation mechanism in the hydraulic lash adjuster (HLA) upon which a cam follower rocker arm pivots. Such an arrangement is advantageous in that it can provide variable lift from a single cam lobe by making the HLA either competent or incompetent to transfer the motion of the cam eccentric to the valve stem. A shortcoming of providing deactivation at the HLA end of a rocker arm is that, because the cam lobe actuates the rocker near its longitudinal center point, the variation in lift produced at the valve-actuating end can be only about one-half of the extent of travel of the HLA deactivation mechanism.

Still another known approach is to provide a deactivation mechanism in the valve-actuating end of a rocker arm cam follower (opposite from the HLA pivot end) which locks and unlocks the valve actuator portion from the follower body. Unlike the HLA deactivation approach, this approach typically requires both high-lift and low-lift cam lobes to provide variable lift.

It is a principal object of the present invention to provide a simplified variable valve lift apparatus wherein manufacturing assembly is simplified and cost is reduced by incorporation of a pre-assembled lock-pin cartridge.

It is a further object of the invention to provide an increased range of motion between a high lift and a low lift position of an engine valve.

SUMMARY OF THE INVENTION

Briefly described, a two-step finger follower rocker arm assembly in accordance with the invention includes an elongate, rigid follower body having a socket at a first end for engaging a conventional hydraulic lash adjuster as a pivot means, and having an arcuate pad at a second and opposite end for engaging a valve stem or lifter means. A passage through the follower body in the direction of actuation by an engine cam lobe is slidingly receivable of a slider member for variably engaging a central cam lobe, preferably a high-lift lobe. A transverse bore in the follower body intersects the passage. A slotted passage is provided in the slider member, and an elongate pin extends through the bore in the slider member and through the slotted passage in the slider member such that the length of travel of the slider member in the passage is at least the length of the slotted passage therein. Outboard of the follower body, the pin is provided on either side of the body with first and second identical lateral roller followers, preferably rotatably mounted in bearings on the pin, for variably engaging first and second lateral cam lobes, preferably low-lift lobes, flanking the central cam lobe. A lost-motion spring urges the slider member into contact with the central lobe, and the hydraulic lash adjuster urges the lateral rollers into contact with the lateral lobes when the slider member is unlatched. A transverse locking pin can selectively engage and lock the slider member to the follower body such that the follower follows the motion of the central cam lobe. When the locking pin is disengaged from the slider member, the member slides within the follower body, allowing the lateral rollers to engage and follow the lateral lobes. Preferably, the central lobe is a high-lift lobe and the lateral lobes are low-lift lobes. Preferably, the locking pin is provided as a pre-assembled cartridge unit.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
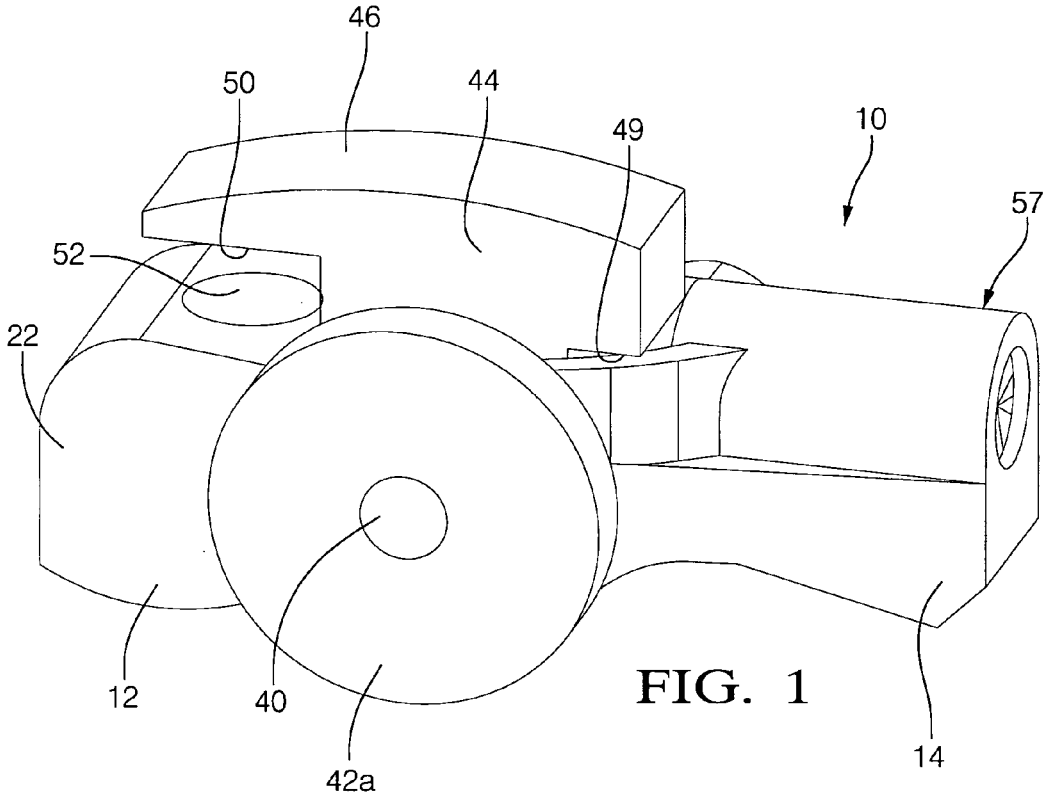
FIG. 1 is an isometric view from the front of a finger follower type rocker arm assembly having means for changing between high and low or no lifts.
Figure 3:
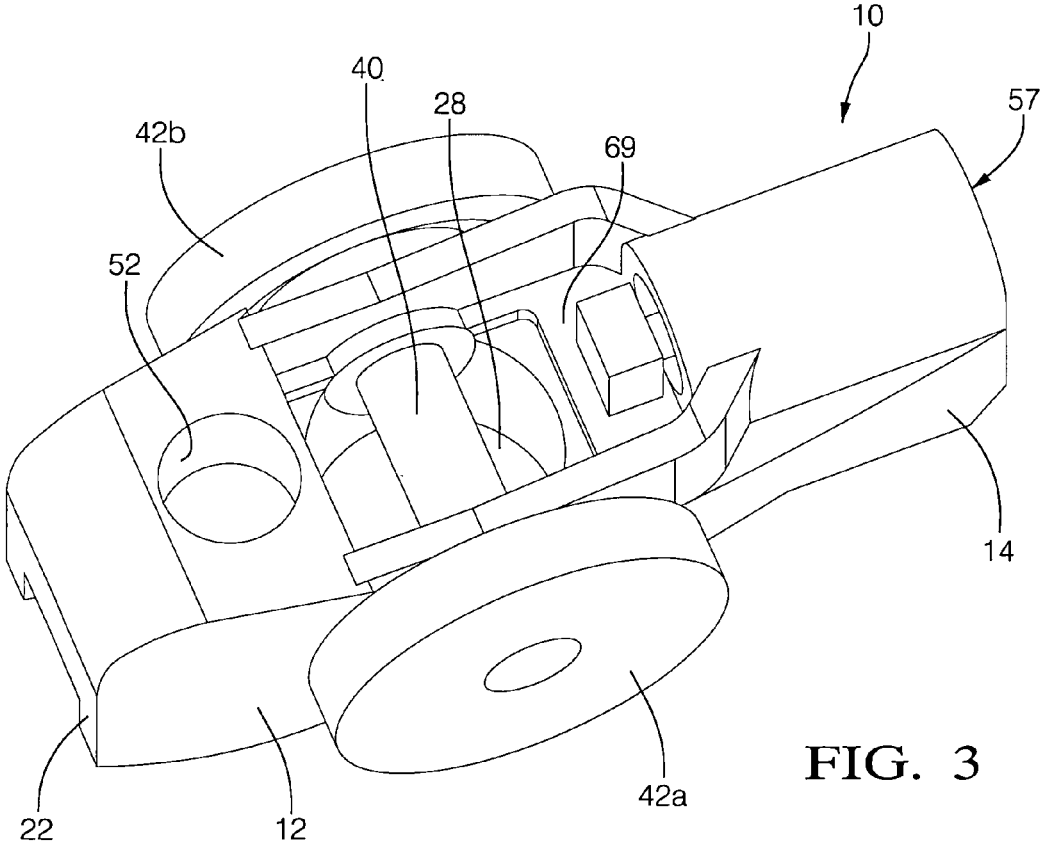
FIG. 3 is an isometric view from above of the rocker arm assembly shown in FIG. 1, the slider member being omitted for illustration.
Figure 2:
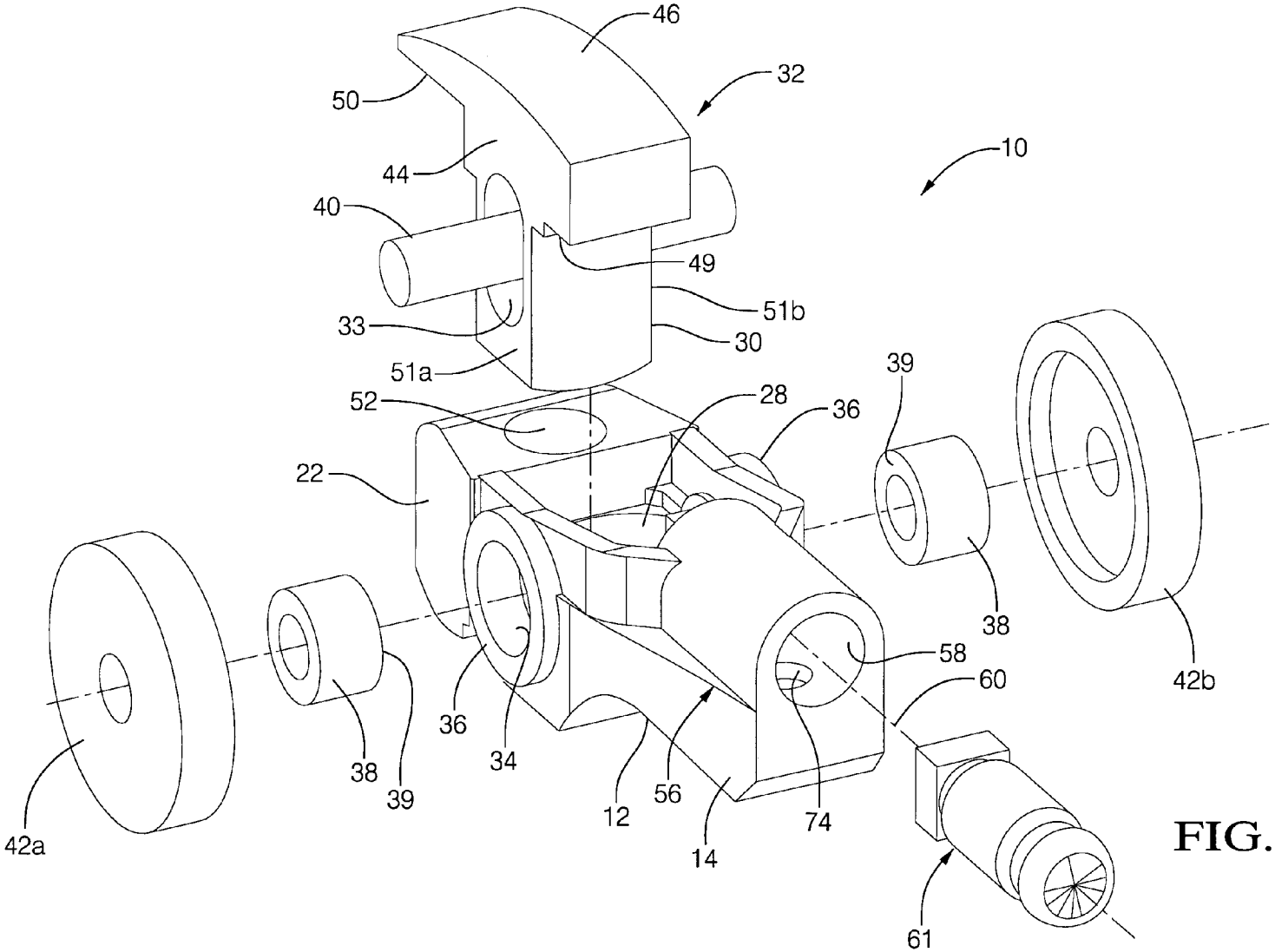
FIG. 2 is an exploded isometric view of the rocker arm assembly shown in FIG. 1.
Figure 6:
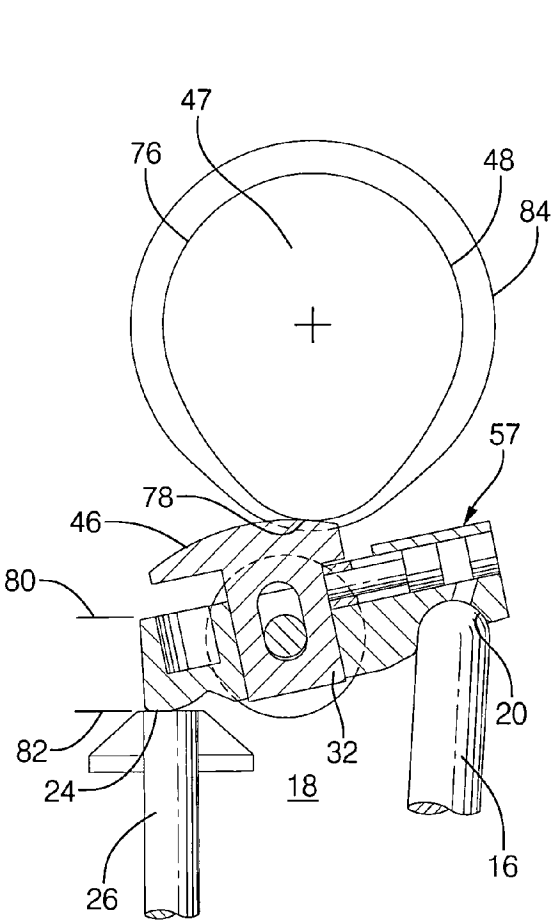
FIG. 6 is an elevational cross-sectional view like that shown in FIG. 4, showing the locking pin in locked position in the slider member, the nose of the central cam lobe on the slider member, and the valve opened to a high-lift position.
Figure 5:
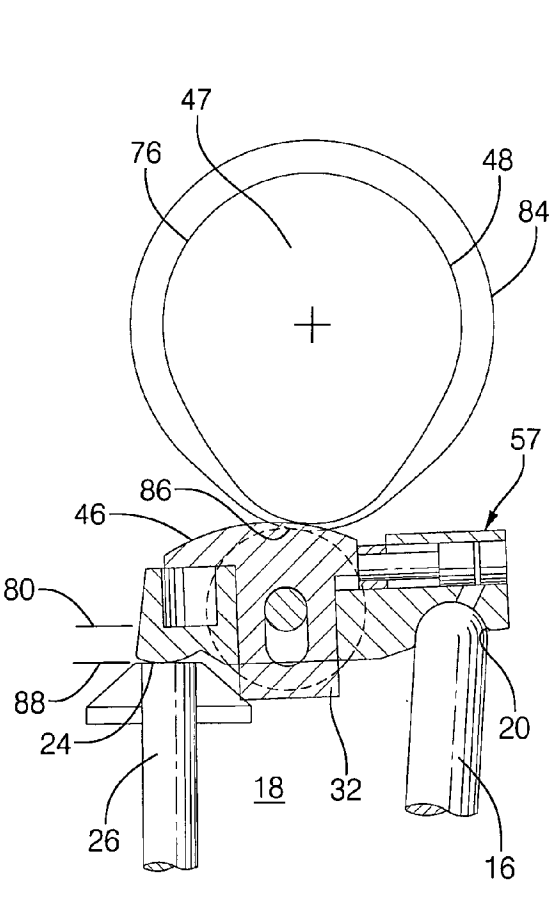
FIG. 5 is an elevational cross-sectional view like that shown in FIG. 4, showing the locking pin still unlocked, the lateral roller followers on the nose of the lateral cam lobes, and the valve opened to a low-lift position.
Figure 4:
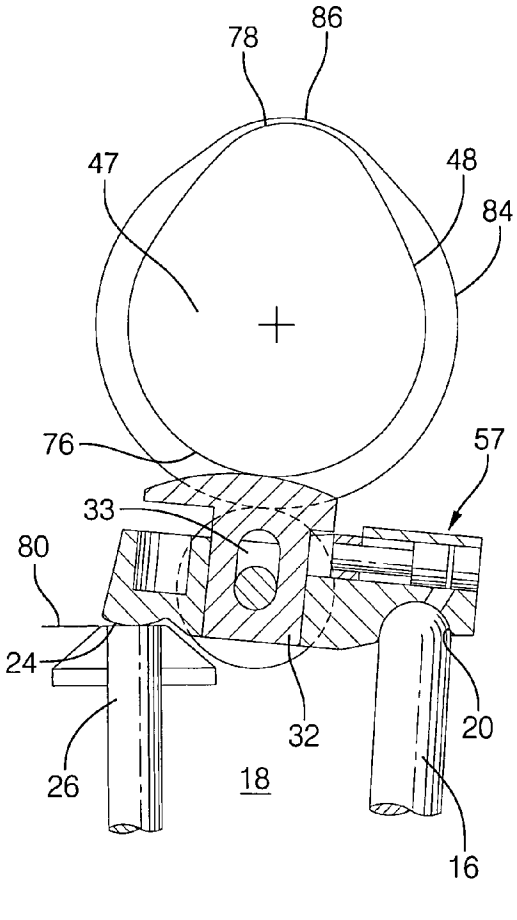
FIG. 4 is an elevational cross-sectional view of the rocker arm assembly shown in FIG. 1, installed schematically in an internal combustion engine and having the associated valve closed, the locking pin unlocked, and the slider member on the base circle portion of the central cam lobe.

Referring to FIGS. 1 through 6, a typical two-step finger follower rocker arm assembly 10, as described in pending application Ser. No. 10/134,263 and incorporated herein by reference, includes a follower body 12 having a first end 14 having means for receiving the head of a hydraulic lash adjuster 16 for pivotably mounting assembly 10 in an engine 18. The receiving means is preferably a spherical socket 20, as shown in FIGS. 4–6. A second and opposite end 22 of follower body 12 is provided with a pad 24, preferably arcuate, for interfacing with and actuating a valve stem 26. Body 12 is provided with a passage 28 therethrough between socket 20 and pad 24, passage 28 being generally cylindrical for slidably receiving a partially-cylindrical mating portion 30 of a slider member 32 having a longitudinal slot 33 therein. Body 12 is further provided with a first bore 34 transverse of passage 28, ending in bosses 36 for receiving roller bearings 38 for rotatably supporting a shaft 40 extending through bore 34 and slot 33 to slidably retain slider member 32 in passage 28. First and second lateral follower rollers 42*a,b* are mounted on opposite ends, respectively, of shaft 40.

Slider member 32 further includes an actuating portion 44 having an arcuate upper surface 46 for engaging a central cam lobe 48 of an engine camshaft (not shown). Portion 44 extends toward first and second ends 14,22 of 12 to define, respectively, a latching surface 49 and a spring seat 50. Second end 22 is provided with a well 52 for receiving a lost-motion spring 54 disposed between end 22 and spring seat 50 (spring 54 shown in FIG. 10 but omitted from the other drawings for clarity).

First end 14 is further provided with a latching mechanism 56 for engaging and locking slider member 32 at its most outward extreme of motion in passage 28. Mechanism 57 comprises a stepped second bore 58 in body 12 and having an axis 60 intersecting passage 28, preferably orthogonally, bore 58 being preferably cylindrical.

Referring to FIGS. 4 through 7, latching mechanism 57 disposed in body 12 of the typical two step finger follower mechanism described above is shown. Latching mechanism 57 includes piston assembly 61, defining a locking pin 62 and piston 63, biased outwards in bore 58 by a return spring 64 and extending toward slider member 32 to support a latch member 66 which may slide along a slide surface 68 in body 12. Bore 58 is closed by a plug 70, forming a hydraulic chamber 72 in communication via passage 74 with socket 20. Pressurized oil may be supplied to chamber 72 in known fashion from HLA 16, upon command from an engine control module (not shown), to cause piston assembly 61 to become hydraulically biased toward slider member 32. When such biasing occurs, to overcome the counter-bias of return spring 64, arcuate surface 46 being engaged on the base circle portion 76 of central cam lobe 48, latch member 66 is urged axially into latching and locking engagement with latching surface 49. As shown in FIG. 6, when cam lobe 48 rotates to engage nose portion 78 with surface 46, valve stem 26 is actuated from a zero lift position 80 to a high lift position 82.

Still referring to FIGS. 4 through 6, central cam lobe 48 is flanked by first and second identical lateral cam lobes 84 (only one visible in FIGS. 4–6) for selectively engaging first and second lateral follower rollers 42*a,b*, respectively. When the engine control module determines, in known fashion from various engine operating parameters, that a low-lift condition is desired, oil pressure is no longer supplied to chamber 72, allowing return spring 64 to again bias piston 62 and associated latch member 66 away from slider member 32. When cam lobe 48 rotates to place surface 46 on base circle portion 76 again, piston assembly 61 unlatches latch member 66 and slider member 32 is again free to slide in passage 28. When the camshaft again rotates to place nose 78 on surface 46, member 32 is depressed into body 12, allowing noses 86 on lateral cam lobes 84 to be engaged by rollers 42*a,b*, as shown in FIG. 5, thus displacing valve stem 26 from zero lift position 80 to a low-lift position 88. As long as oil pressure is withheld from chamber 72, latching mechanism 56 remains disengaged from slider member 32, and assembly 10 functions as a low-lift rocker.

Of course, it will be seen by those of skill in the art that the dimensions of the lateral cam lobes and lateral follower rollers may be configured to provide any desired degree of lift to valve stem 26 in a range between positions 80 and 88.

It will further be seen that, within the scope of the invention, the dimensions of all the lobes, follower rollers, and the slider member may be configured, and the engine control module so programmed, if desired such that low-lift is achieved via the central cam lobe and high lift via the lateral cam lobes.

Figure 7:
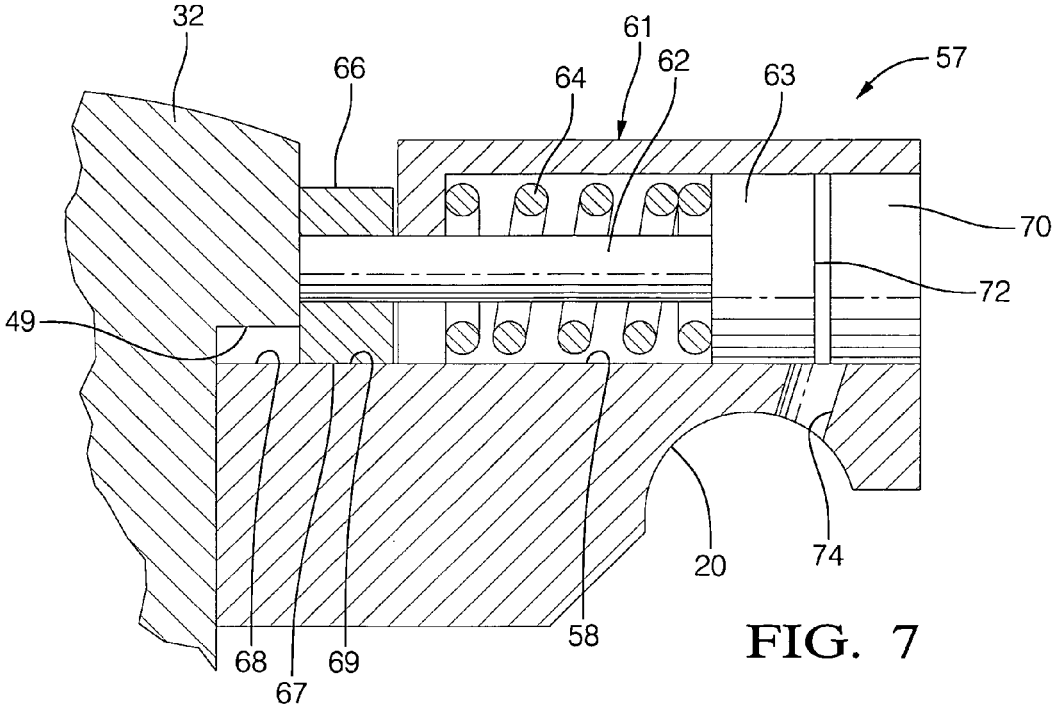
FIG. 7 is an elevational cross-sectional view of the locking pin assembly shown in FIGS. 1–6.
Figure 9:
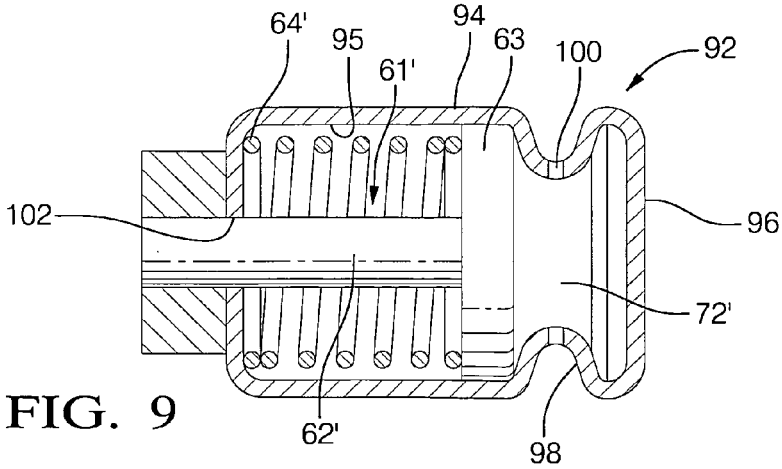
FIG. 9 is a view like that shown in FIG. 8, showing a cartridge pin subassembly without the piston extension, as would be configured for hydraulic actuation of the locking pin.
Figure 10:
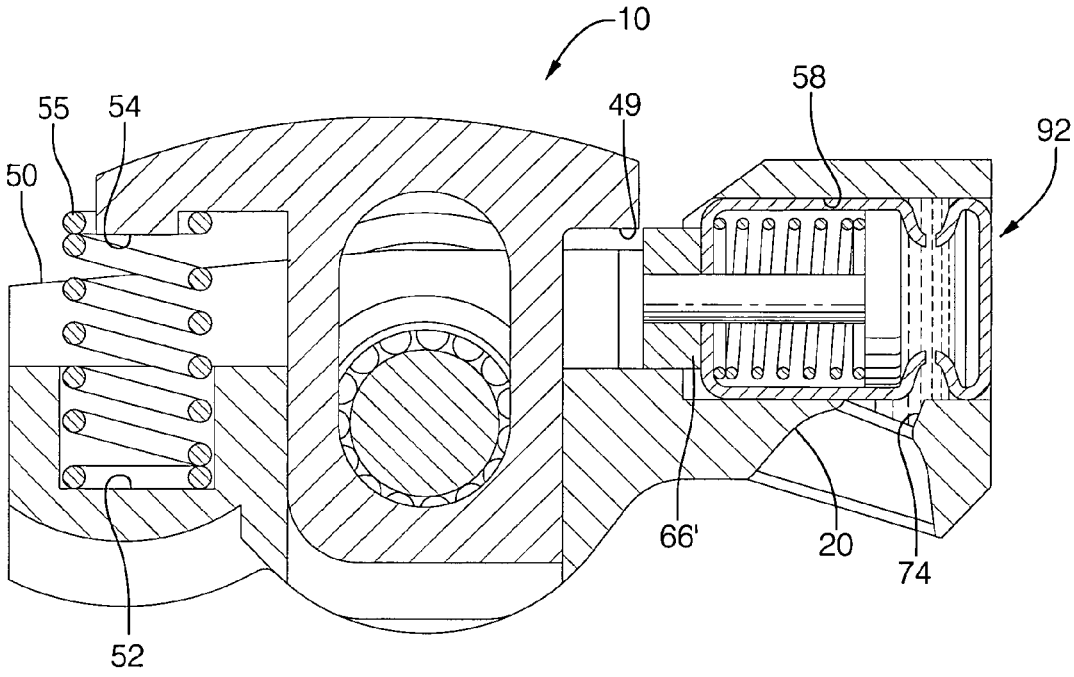
FIG. 10 is an elevational cross-sectional view of an example of a two-step finger follower, including the cartridge pin sub-assembly shown in FIG. 8, the pin and slider member being in the unlocked position.
Figure 11:
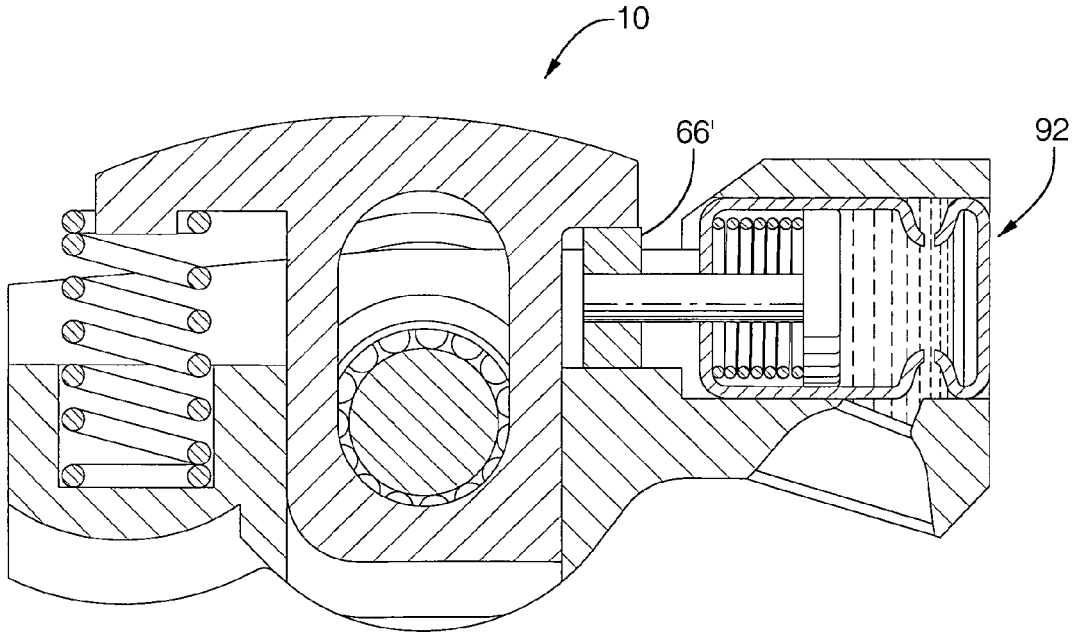
FIG. 11 is an elevational cross-sectional view like that shown in FIG. 10, showing the pin and slider member in the locked position.

Referring to FIGS. 9 through 11, a first embodiment in accordance with the invention is shown, comprising a latching cartridge 92 which may be inserted into bore 58 (FIG. 7) and which is preferably and conveniently pre-assembled as a subassembly, thereby greatly simplifying the overall assembly of follower 10. Cartridge 92 includes a body 94, preferably tubular and including a bore 95 closed at outer end 96. Body 94 is sized to be close-fitted into bore 58, thereby eliminating the need for plug 70. Catridge 92 includes piston assembly 61' comprising piston 63 and locking pin 62'. Preferably, body 94 is constricted 98 to separate piston 63 from end 96, thereby providing a hydraulic chamber 72' within the cartridge. Constriction 98 is perforated 100 to allow hydraulic communication with passage 74 and socket 20 (FIG. 7). Body 94 is partially closed at inner end 102 to retain return spring 64' in spring chamber 65 and provide guidance for locking pin 62' in driving latch member 66' into engagement (FIG. 11) and out of engagement (FIG. 10) with latching surface 49.

Figure 8:
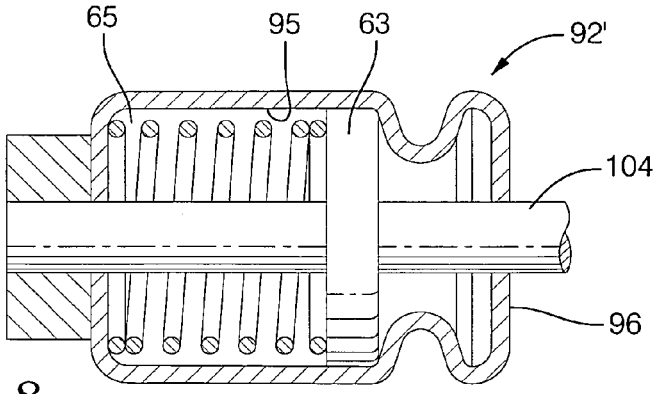
FIG. 8 is an elevational cross-sectional view of a first embodiment of a locking pin assembly, showing a cartridge pin subassembly having a piston extension for mechanical actuation of the locking pin.

Referring to FIG. 8, a variation 92' of cartridge 92 is provided with a piston extension 104 slidably extending through outer end 96 for engagement by mechanical or electromechanical actuation means (not shown), for example, a conventional solenoid actuator, in place of the previously-discussed hydraulic actuation.

Figure 12:
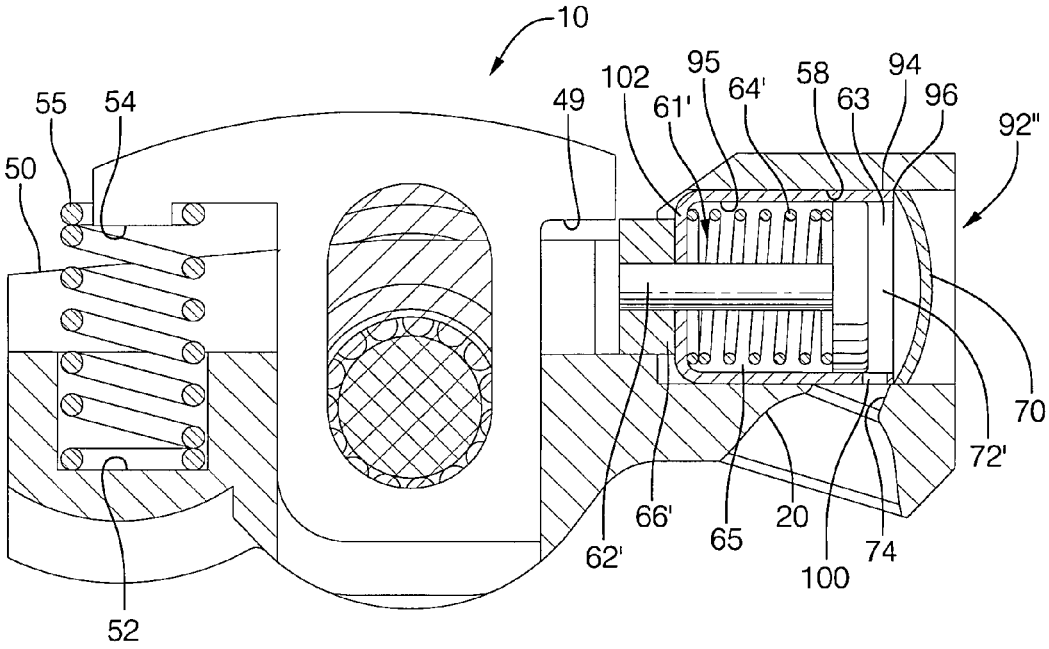
FIG. 12 is an elevational cross-sectional view of an alternate, open-ended version of the cartridge sub-assembly shown in FIG. 8, the pin and slider member being in the unlocked position.

Referring to FIG. 12, another variation 92" is provided, which may be inserted into bore 58 (FIG. 7) and which, like embodiment 92 and 92', is preferably and conveniently pre-assembled as a subassembly, thereby greatly simplifying the overall assembly of follower 10. Cartridge 92" includes a body 94, preferably tubular and including a bore 95 opened at outer end 96. Body 94 is sized to be fitted into bore 58, Bore 58 is sealed proximate body outer end 96 with plug 70. Catridge 92" includes piston assembly 61' comprising piston 63 and locking pin 62'. Preferably, body 94 is provide with at least one slot or perforation 100 thereby providing hydraulic communication between chamber 72' and oil passage 74. Body 94 is partially closed at inner end 102 to retain return spring 64' in spring chamber 65 and provide guidance for locking pin 62' in driving latch member 66' into engagement (FIG. 11) and out of engagement (FIG. 10) with latching surface 49.

Figure 13:
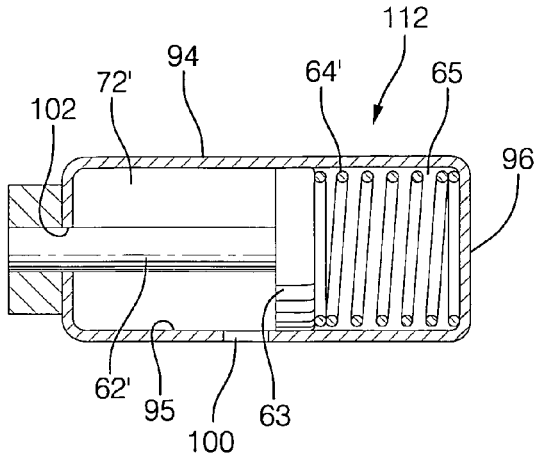
FIG. 13 is an elevational cross-sectional view of a second embodiment of a locking pin sub-assembly.
Figure 14:
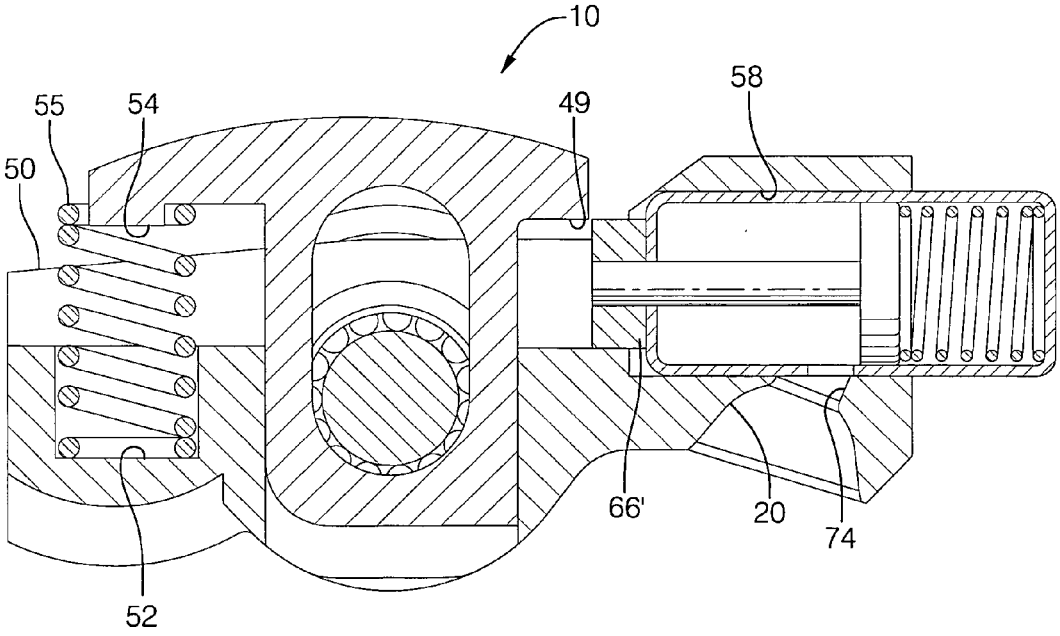
FIG. 14 is an elevational cross-sectional view of a two-step finger follower in accordance with the invention, including the cartridge pin sub-assembly shown in FIG. 13, the pin and slider member being in the unlocked position.

Referring to FIGS. 13 and 14, a second embodiment of a latching cartridge 112 is shown for a latching mechanism 57 in accordance with the invention. In embodiment 112, the hydraulic chamber 72' and return spring 64' are reversed, such that assembly 10 is latched by spring 64' when oil pressure is removed, and is unlatched when oil pressure is applied to chamber 72'. Latching cartridge 112 may be inserted into bore 58 and is preferably and conveniently pre-assembled as a subassembly, thereby greatly simplifying the overall assembly of follower 10. Cartridge 112 includes a body 94, preferably tubular and including a bore 95 closed at outer end 96. Body 94 is sized to be close-fitted into bore 58, thereby eliminating the need for plug 70. Body 94 is perforated 100 to allow hydraulic communication of hydraulic chamber 72' with passage 74 and socket 20. Body 94 is partially closed at inner end 102 to provide guidance for locking pin 62' in driving latch member 66' into and out of engagement with latching surface 49. Return spring 64 is captured in spring chamber 65 between piston 63 and end 96.

Figure 15:
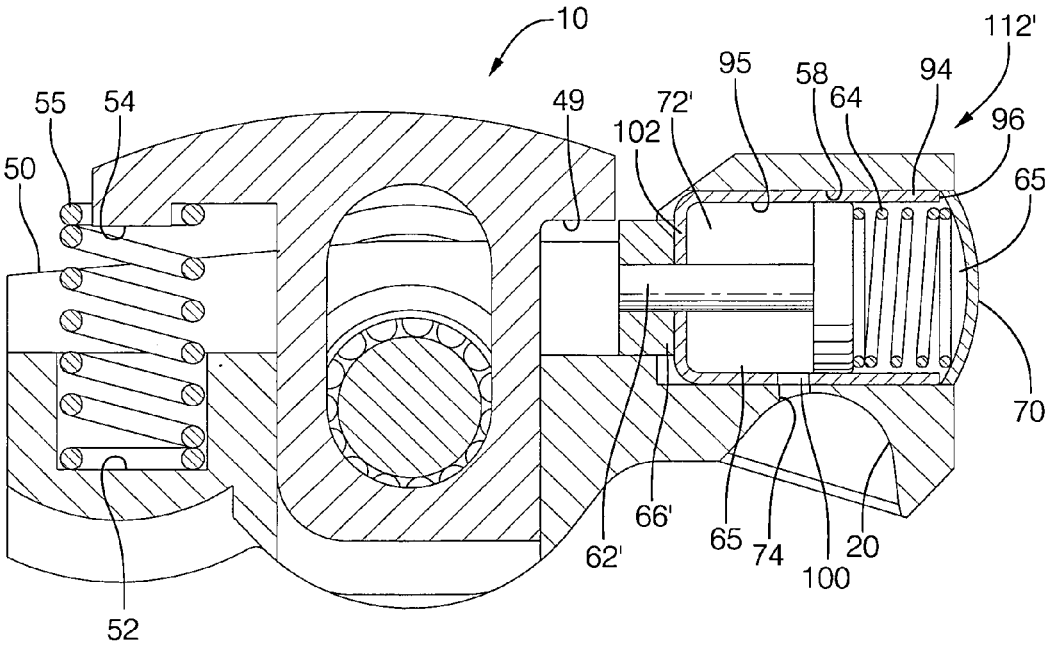
FIG. 15 is an elevational cross-sectional view of an alternate, open ended version of the cartridge pin sub-assembly shown in FIG. 14, the pin and slider member being in the unlocked position.

Referring to FIG. 15, another version 112' of the second embodiment is shown in accordance with the invention. Like embodiments 92, 92', and 112, cartridge 112' is preferable and conveniently pre-assembled as a subassembly, thereby greatly simplifying the overall assembly of follower 10. In embodiment 112', as in embodiment 112, the hydraulic chamber 72' and return spring 64' are reversed, such that assembly 10 is latched by spring 64' when oil pressure is removed, and is unlatched when oil pressure is applied to chamber 72'. Cartridge 112' includes a body 94, preferably tubular and including a bore 95 opened at outer end 96. Body 94 is sized to be fitted into bore 58; bore 58 is sealed proximate body outer end 96 with plug 70. Body 94 is perforated 100 to allow hydraulic communication of hydraulic chamber 72' with passage 74 and socket 20. Body 94 is partially closed at inner end 102 to provide guidance for locking pin 62' in driving latch member 66' into and out of engagement with latching surface 49. Return spring 64 is captured in spring chamber 65 between piston 63 and end 96.

Cartridges 92,92',112 and 112' are useful in all types of variable valve actuation rocker arm assemblies, not just those discussed above, wherein lock pin mechanisms are used to latch and unlatch components of a rocker arm mechanism to vary the lift of associated valves. Cartridges in accordance with the invention contain the entire locking mechanism in a single assembly, which reduces the precision required in a receiving bore in a rocker arm mechanism. The entire cartridge may be pre-assembled and tested inexpensively before insertion into the arm assembly, thereby simplifying rocker arm assembly, reducing the manufacturing cost, and increasing the reliability.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A lock-pin cartridge for incorporation into a variable valve activation assembly to latch and unlatch a first member thereof from a second member thereof, the cartridge comprising:

a) a body disposable on said first member and having an axial bore having first and second ends, said first end having a closure, said second end being partially closed and having a passage therethrough;

b) a piston assembly having a locking pin and a piston disposed in said bore, said locking pin extending through said second end passage to provide said latching and unlatching of said first and second members, said piston being spaced apart from said first and second ends to define a hydraulic chamber and a spring chamber within said bore on opposite sides of said piston; and c) biasing means disposed in said spring chamber between said partially closed second end and said piston for urging said piston assembly toward said first end.

2. A lock-pin cartridge in accordance with claim 1 wherein said hydraulic chamber comprises said first end and said spring chamber comprises said second end.

3. A lock-pin cartridge in accordance with claim 1 wherein said body includes a constriction.

4. A lock-pin cartridge in accordance with claim 1 wherein a latch member is disposed on said locking pin.

5. A lock-pin cartridge for incorporation into a variable valve activation assembly to latch and unlatch a first member thereof from a second member thereof, the cartridge comprising:

a) a body disposable on said first member and having an axial bore having first and second ends, said first end having a closure, said second end being partially closed and having a passage therethrough:

b) a piston assembly having a locking pin and a piston disposed in said bore, said locking pin extending through said second end passage to provide said latching and unlatching of said first and second members, said piston being spaced apart from said first and second ends to define a hydraulic chamber and a spring chamber within said bore on opposite sides of said piston; and c) biasing means disposed in said spring chamber between said first end and said piston for urging said piston assembly toward said second end, wherein said spring chamber comprises said first end and said hydraulic chamber comprises said second end.

6. A lock-pin cartridge in accordance with claim 1 further comprising at least one perforation in said body for providing oil to said hydraulic chamber.

7. A lock-pin cartridge for a variable valve activation rocker arm, comprising:

a) a body having a closure at a first end and a partially closed second end;

b) a piston assembly disposed in said body and extending through said second end thereof for latching and unlatching said rocker arm, said piston assembly being spaced apart from said first end to define a hydraulic chamber in said body; and c) spring means disposed in said body between said piston assembly and said partially closed second end for urging said piston assembly toward said first end.

8. A lock-pin cartridge in accordance with claim 7 further comprising piston extension means attached to said piston assembly and extending through an aperture in said first end closure for engaging piston actuating means.

9. A variable valve activation assembly wherein a first member is latchable and unlatchable from a second member thereof, comprising a lock-pin cartridge including:

a body disposable on said first member and having an axial bore having first and second ends, said first end having a closure, said second end being partially closed and having a passage therethrough, a piston assembly having a locking pin and a piston disposed in said bore, said locking pin extending through said second end passage to provide said latching and unlatching of said first and second members, said piston being spaced apart from said first and second ends to define a hydraulic chamber and a spring chamber within said bore on opposite sides of said piston, and biasing means disposed in said spring chamber between said partially closed second end and said piston for urging said piston assembly toward said first end.

10. An assembly in accordance with claim 9 wherein said first member includes a bore for receiving said lock-pin cartridge.

11. An assembly in accordance with claim 9 wherein said body includes a constriction.

12. An assembly in accordance with claim 9 wherein a latch member is disposed on said locking pin.

* * * * *